US007841667B2

(12) United States Patent
Mossbeck

(10) Patent No.: US 7,841,667 B2
(45) Date of Patent: Nov. 30, 2010

(54) SEATING SUPPORT SYSTEM

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 168 days.

(21) Appl. No.: 12/098,239

(22) Filed: Apr. 4, 2008

(65) Prior Publication Data

US 2009/0250991 A1 Oct. 8, 2009

(51) Int. Cl.
*A47C 7/02* (2006.01)
*A47C 7/46* (2006.01)

(52) U.S. Cl. ..... 297/452.48; 297/452.41; 297/452.52; 297/284.4

(58) Field of Classification Search ..... 297/284.1, 297/284.4, 284.6, 284.3, 452.48, 452.49, 297/452.52, 452.53
See application file for complete search history.

(56) References Cited

U.S. PATENT DOCUMENTS

| | | | | | |
|---|---|---|---|---|---|
| 3,145,054 | A | * | 8/1964 | Sopko Jr. | 297/452.3 |
| 3,983,587 | A | | 10/1976 | Gorran | |
| 4,155,592 | A | * | 5/1979 | Tsuda et al. | 297/284.2 |
| 4,437,702 | A | | 3/1984 | Agosta | |
| 4,445,240 | A | | 5/1984 | Voorhees | |
| D284,139 | S | | 6/1986 | Ko | |
| 4,592,589 | A | | 6/1986 | Hellwig | |
| 4,746,168 | A | * | 5/1988 | Bracesco | 297/440.2 |
| 5,046,205 | A | | 9/1991 | Garcia | |
| 5,076,643 | A | * | 12/1991 | Colasanti et al. | 297/284.6 |
| 5,379,471 | A | | 1/1995 | Holdredge | |
| 5,500,965 | A | | 3/1996 | Hannagan et al. | |
| 5,634,223 | A | | 6/1997 | Obermaier | |
| 5,678,265 | A | | 10/1997 | Meyer | |
| 5,711,575 | A | | 1/1998 | Hand et al. | |
| 5,860,699 | A | * | 1/1999 | Weeks | 297/284.6 |
| 5,868,466 | A | * | 2/1999 | Massara et al. | 297/284.6 |
| 5,881,407 | A | | 3/1999 | Chu Pt | |
| 5,967,608 | A | * | 10/1999 | Van Sickle | 297/284.6 |
| 6,015,471 | A | | 1/2000 | Rimington et al. | |
| 6,129,419 | A | * | 10/2000 | Neale | 297/284.4 |
| 6,413,194 | B1 | | 7/2002 | Gant | |
| 6,682,145 | B2 | | 1/2004 | Wilkerson et al. | |
| 6,782,573 | B2 | | 8/2004 | Odderson | |

(Continued)

OTHER PUBLICATIONS

PCT Search Report; PCT No.: PCT/US2009/039428; Dated May 29, 2009, 10 pages.

*Primary Examiner*—Sarah B McPartlin
(74) *Attorney, Agent, or Firm*—Shook Hardy & Bacon

(57) ABSTRACT

A seating product, such as a chair, has a frame. The frame defines the seating area and back area of the seating product. A series flexible straps extend across the seating area and back area. In a similar fashion, a series of spring supports extend over the flexible straps and the seating and back areas. The straps and the spring supports hold an inflatable bladder in the lumbar region of the back area. The straps and the spring supports in the seating area hold another inflatable bladder in the seating area. The bladders are coupled to a pump controllable to inflate and deflate the bladders. When deflated, the seating product has a suspension and feel like that of traditional seating products. The bladders can be selectively and individually inflated to provide a customized support in the seating product. The flexible straps provide a suspension surface for the air bladders.

18 Claims, 2 Drawing Sheets

U.S. PATENT DOCUMENTS

| | | | | |
|---|---|---|---|---|
| 6,826,795 | B2 | 12/2004 | Wilkinson | |
| 7,000,276 | B2 | 2/2006 | Chaffee | |
| 7,024,714 | B1 | 4/2006 | Yates | |
| 7,048,703 | B2 | 5/2006 | Riach | |
| 7,114,783 | B2 | 10/2006 | Warren et al. | |
| 7,559,607 | B2 * | 7/2009 | Archambault et al. | 297/284.7 |
| 2006/0085919 | A1 | 4/2006 | Kramer et al. | |
| 2008/0136226 | A1 * | 6/2008 | Cherubini et al. | 297/217.2 |

* cited by examiner

SEATING SUPPORT SYSTEM

BACKGROUND

Chairs and sofas have been used to provide a comfortable resting environment, and use an underlying support structure to support those sitting in the chairs and sofas. Seating support structures used in the furniture industry are known and varied. These seating arrangements provide support with a seat and a back support, and may include arm rests. The chairs found in many homes today are often provided with cushioning and a spring-type suspension system. This increases the comfort of those using the chairs. Most chairs and sofas, however, do not offer an adjustable support system. The support provided, in whatever form it takes, cannot be changed by the user.

Some seating systems have been developed that utilize a pneumatic bladder to provide support in the lumbar area or seat area. These systems must provide some type of support for the bladder. If the bladder is merely placed in the cushioning material, the bladder will merely expand downwardly away from the support surface, negating the use of the bladder as an additional support. So, these systems have utilized a rigid support surface for the bladder. The disadvantage of these systems is that the user may have a feeling of "bottoming out" against the hard surface.

Therefore, it is an objective of the present invention to provide a seating product offering a practical adjustable support system for use in sofas, chairs and other seating arrangements.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention relate to a seating product having a frame. The frame defines the seating area and back area of the seating product. A series flexible straps extend across the seating area and back area. In a similar fashion, a series of spring supports extend over the flexible straps in the seating and back areas. The straps and the spring supports hold an inflatable bladder in the lumbar region of the back area. The straps and the spring supports in the seating area hold another inflatable bladder in the seating area. The bladders are coupled to a pump, controllable to inflate and deflate the bladders. When deflated, the seating product has a suspension and feel like that of traditional seating products. The bladders can be selectively and individually inflated to provide a customized support in the seating product. The flexible straps provide a suspension surface for the air bladders. This allows the air bladders to provide additional support to the seating product, without using a rigid support thereby reducing any feeling of the user "bottoming out" against a hard surface.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

Figure 1:
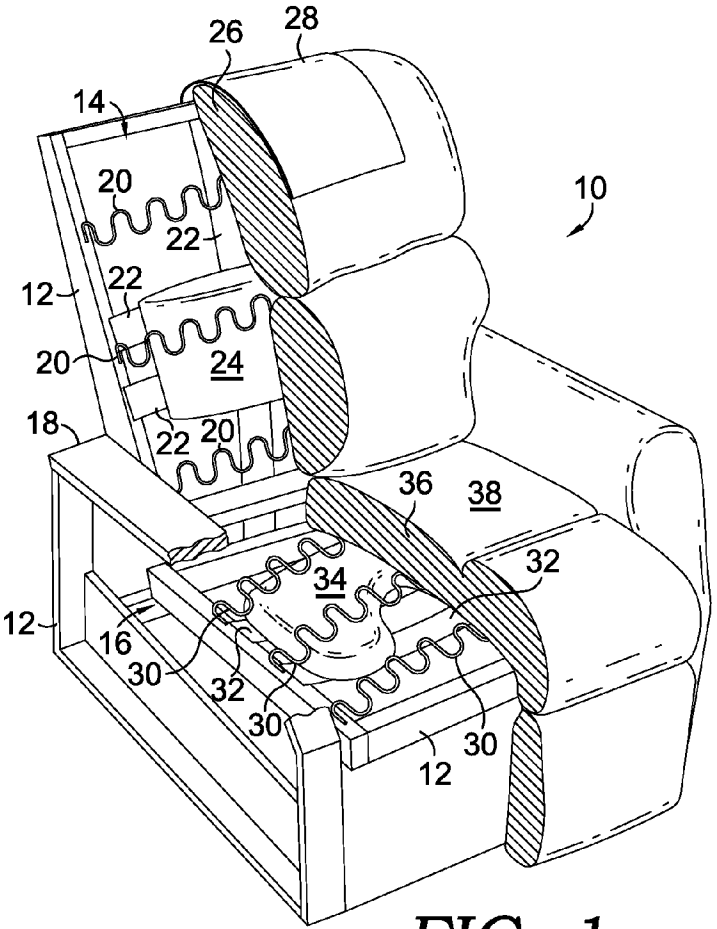
FIG. 1 is a partial perspective view, partially cut away of a seating product in accordance with an embodiment of the present invention.

Referring to the drawings, and particularly to FIG. 1, there is illustrated a seating product 10, shown in the Figures as a chair. It should be understood that the following description uses a chair to describe the seating product 10, but that the invention could be used with other seating products. The chair 10 has a supporting frame 12, typically made of wood. The frame 12 defines the overall shape of the chair, including a back area 14, seat area 16 and a pair of arms 18. The frame of the back area 14 provides a supporting structure for a series of springs 20. Springs 20 are typically and preferably a sinusoidal shape, as is known to those of skill in the art. The springs 20 are coupled to the frame and bow outwardly toward the back of a user sitting in the chair.

A series of flexible straps 22 are also coupled to the frame in back area 14. As an example, straps 22 are stapled to the frame in back area 14. The straps 22 are located rearward of the springs 20. Preferably, straps 22 are a knit material that is 60% polyester and 40% rubber. In a preferred embodiment, the maximum elongation of straps 22 is 140%. Straps having other elongation properties could also be used, depending on the support desired by the designers of the chair.

An air bladder 24 is held in place between the springs 20 and straps 22. The straps 22 hold the bladder in place in any condition between fully deflated and inflated. The bladder is located in the lumbar region, such that it can provide additional support to the lumbar area of a user sitting in the chair 10. Bladder 24 can be made from any durable material. In the current preferred embodiment, bladder 24 is made from a polyurethane material.

As with other chairs, a cushioning material 26 is disposed on top of the springs 20 and completely covers the back area 14. A cover 28 extends over the cushioning material 26 to provide the surface exposed to the user of the chair 10. Any of the materials known to those of skill in the art in the furniture industry are acceptable for use as cushioning material 26 and cover 28.

Like the back area 14, the frame of the seat area 16 provides a supporting structure for a series of springs 30. Springs 30 are typically and preferably the sinusoidal shape of those on the back area 14. The springs 30 are coupled to the frame and bow upwardly toward the user sitting in the chair. As an example, springs 20 and 30 can be coupled to the frame with a series of connecting clips.

A series of flexible straps 32 are also coupled to the frame in seat area 14. As with straps 22, straps 32 are stapled to the frame in seat area 16. The straps 32 are located under the springs 30. Preferably, straps 32 are made from the same material as straps 22. It should be understood that straps 22 and straps 32 could be made from different material, if different elongation characteristics were desired in seat area 16 than back area 14.

Figure 4:
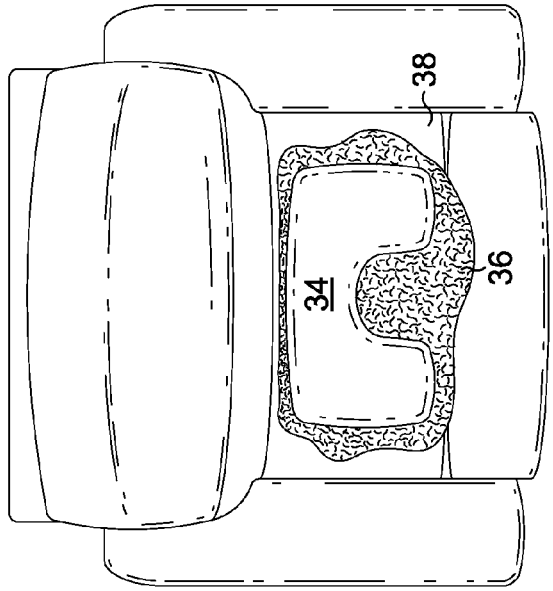
FIG. 4 is a top view with parts broken away to show the orientation of the seat bladder in one embodiment of the invention.
Figure 3:
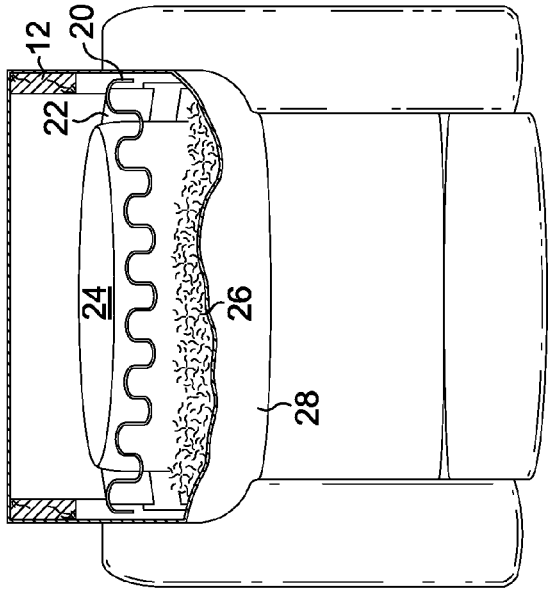
FIG. 3 is a sectional view taken along line 3-3 of FIG. 2.

An air bladder 34 is held in place between the springs 30 and straps 32. The straps 32 hold the bladder in place in any condition between fully deflated and inflated. The bladder 34 is preferably u-shaped, or half dog bone shape, such as that shown in FIG. 4. The shape as shown provides support for the legs of the person sitting in chair 10, while not providing unneeded support in the area of the tailbone. Bladder 34 is preferably made from the same material as bladder 24. Bladders 24 and 34 have been described as air bladders, but it should be understood that other types of fluid or gas filled bladders could also be used.

As with other chairs, a cushioning material 36 is disposed on top of the springs 30 and completely covers the seat area 16. A cover 38 extends over the cushioning material 36 to provide the surface exposed to the user of the chair 10. The cover 38 is, in most cases, the same material as that of cover 28 so that covers 28 and 38 match.

Figure 2:
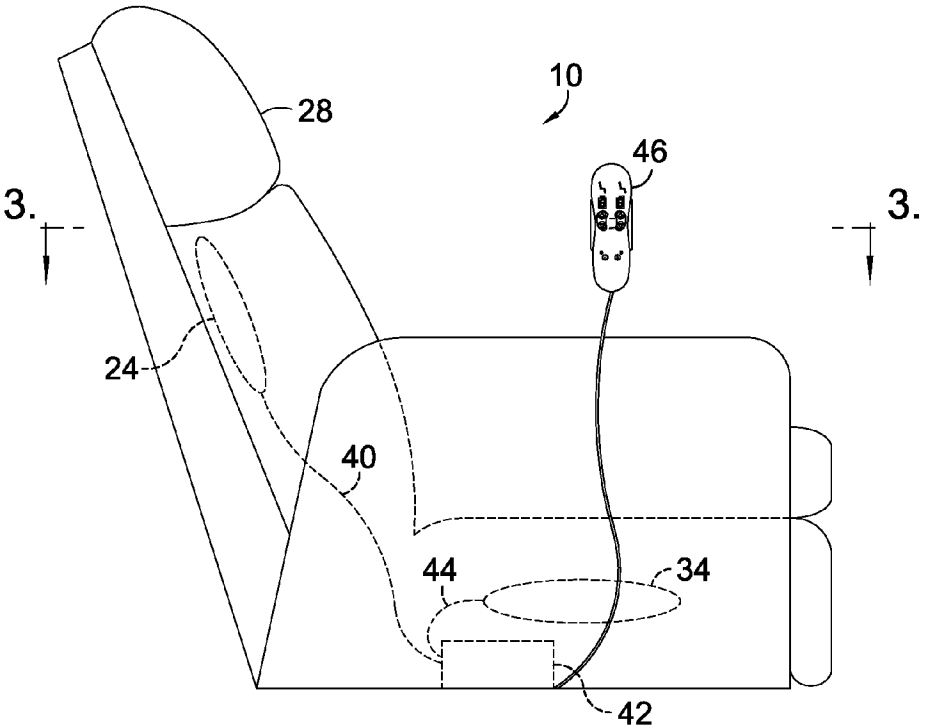
FIG. 2 is a side view of a seating product in accordance with an embodiment of the present invention.

As best seen in FIG. 2, an air tube 40 extends from bladder 24 to a pump 42. Pump 42 is operable to inflate or deflate bladder 24. In a preferred embodiment, pump 42 is an electric pump. Similarly, an air tube 44 extends from bladder 34 to the pump 42. Pump 42 is operable to selectively inflate or deflate bladder 24 separate and apart from inflation of bladder 24. It should be understood that a single pump 42 is shown, and is preferred, but that multiple pumps could be used and be within the scope of the present invention. With continued reference to FIG. 2, a hand-wand control 46 is coupled to pump 42 and is used to control the pump.

Figure 5:
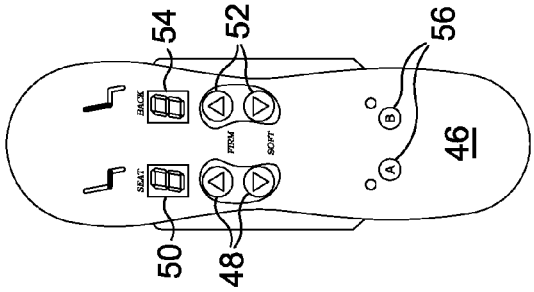
FIG. 5 is a top plan view of an exemplary control device for use with the invention.

The hand-wand control 46 is best seen in FIG. 5. As shown, the control 46 preferably has buttons 48 used to activate the pump 42 to increase or decrease the inflation of bladder 34. A level indicator 50 is used to show the user the currently selected level of inflation for bladder 34. Similarly, the control 46 has buttons 52 to activate the pump 42 to increase or decrease the inflation of the bladder 24. A level indicator 54 is used to show the user the currently selected level of inflation for bladder 24 in the seat area. Preferably, the control has preset buttons 56 used to move the bladders 24 and 34 to desired presets for a user.

In use, bladders 24 and 34 can be completely deflated. In this condition, the chair 10 will feel the same to a user as any other chair. If the user desires additional support in the lumbar area, the hand-wand control 46 is used to inflate bladder 24 using buttons 52. As the bladder 24 inflates, the straps 22 will elongate as the bladder inflates. At the same time, the bladder 24 will exert an outward force toward the user and against the springs 20. As the bladder 24 continues to inflate, the straps 22 will eventually reach maximum elongation so that further inflation of bladder 24 operates to increase the support toward the springs 20 and the lumbar region of the user.

The user may also desire additional support in the seating area. To increase support, the hand-wand control 46 is used to inflate bladder 34 using buttons 48. As the bladder 34 inflates, the straps 32 will elongate as the bladder 34 inflates. At the same time, the bladder 34 will exert an upward force toward the user and against the springs 30. As the bladder 34 continues to inflate, the straps 32 will reach maximum elongation so that further inflation of bladder 34 operations to increase the support provided in the seating area of the user.

The user may also set the buttons 56 to desired preset levels. Thereafter, the user may select one of the buttons 56 to inflate the bladders 24 and 34 to the levels corresponding to the desired pre-selected levels. This allows the user to customize the chair 10 to achieve the support most comfortable.

While not shown, it should be understood that the principles of the present invention can be used with motion furniture as well. In other words, the furniture may be equipped with recliner and footrest mechanisms. The support system of the straps, bladders and springs is low-profile, and so does not interfere with these motion mechanisms. This allows the support system to be used on a wide variety of furniture.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. A seating product comprising:

a frame defining a back area of the seating product;

a spring extending across the back area, a flexible strap extending across the back area in a same area as the spring and behind the spring, wherein the flexible strap is attached to the frame at flexible-strap end portions, such that a middle section of the flexible strap elongates between the flexible-strap end portions when pressure is applied to the middle section;

a first inflatable bladder disposed between, and held in position by, the spring and the flexible strap;

a cushioning material disposed over the spring, and a covering disposed over said cushioning to provide a user-support surface.

2. The seating product of claim 1, further comprising a pump coupled to the first inflatable bladder and operable to inflate or deflate the bladder.

3. The seating product of claim 2, further comprising a hand-wand control operable to control the pump.

4. The seating product of claim 1, further comprising a first plurality of flexible straps adjacent the flexible strap.

5. The seating product of claim 4, further comprising, a plurality of springs extending across a seat area;

a second plurality of flexible straps extending across the seat area in the same area as at least one spring of the plurality of springs; and a second inflatable bladder disposed between, and held in position by, the plurality of springs in the seat area and the second plurality of flexible straps.

6. The seating product of claim 5, wherein the second inflatable bladder is coupled to the pump such that the pump is operable to selectively inflate or deflate the first and second bladders.

7. The seating product of claim 6, wherein the bladders are filled using air and the pump is a pneumatic pump.

8. The seating product of claim 5, wherein the second inflatable bladder is generally u-shaped, with a base of the u extending along a rear of the seat.

9. A seating support system, comprising:

a frame defining a seating area;

an elastic knitted strap extending across the seating area defined by the frame;

a first inflatable bladder disposed on top of said elastic knitted strap; and a wire spring extending across the seating area and over said first inflatable bladder, such that the first inflatable bladder is disposed between, and held in position by, the elastic knitted strap and the wire spring.

10. The seating support system of claim 9, wherein the first inflatable bladder has a u-shape with arms of the u extending along sides of the seating area and a base of the u extends along a rear of the seating area.

11. The seating support system of claim 10, wherein the elastic knitted strap is made from polyester and rubber with a maximum elongation of 140%.

12. The seating support system of claim 11, further comprising a pneumatic pump coupled to the first inflatable bladder and operable to inflate and deflate the first inflatable bladder.

13. The seating support system of claim 11, further comprising a hand-wand pump control having a plurality of preset buttons used inflate the first inflatable bladder to desired predetermined settings.

14. The seating support system of claim 9, wherein the frame further defines a back area, the seating support system further comprising:

an elastic knitted strap extending across the back area defined by the frame;

a wire spring extending across the back area; and a second inflatable bladder disposed between, and held in position by, the elastic knitted strap extending across the back area and the wire spring extending across the back area.

15. A chair having an adjustable support system, comprising:

a frame defining a back area and a seat area;

a plurality of spring wires extending across the back area and the seat area;

a plurality of flexible straps extending across the back area and the seat area, wherein each flexible strap is attached to the frame near respective flexible-strap end portions, such that each flexible strap includes a respective middle portion between the respective flexible-strap end portions;

a first inflatable bladder disposed between, and held in position by, a spring wire and a flexible strap in the back area, wherein, when the first flatable bladder applies a force against a middle portion of the flexible strap, the middle portion elongates; and a second inflatable bladder disposed between, and held in position by, another spring wire and another flexible strap in the seat area.

16. The chair of claim 15, wherein the spring wires are sinusoidal springs.

17. The chair of claim 16, further comprising a pump coupled to the first and second inflatable bladders and operable to selectively inflate and deflate the first and second bladders.

18. The chair of claim 16, wherein the second inflatable bladder is generally u-shaped and is oriented with a base of the u along a rear of the seat area.

* * * * *